US010492618B2

(12) United States Patent
Sokvitne

(10) Patent No.: US 10,492,618 B2
(45) Date of Patent: Dec. 3, 2019

(54) MATTRESS SECURING SYSTEM

(71) Applicant: Dwain Sokvitne, Calgary (CA)

(72) Inventor: Dwain Sokvitne, Calgary (CA)

( * ) Notice: Subject to any disclaimer, the term of this patent is extended or adjusted under 35 U.S.C. 154(b) by 194 days.

(21) Appl. No.: 15/662,036

(22) Filed: Jul. 27, 2017

(65) Prior Publication Data

US 2019/0029437 A1 Jan. 31, 2019

(51) Int. Cl.
*A47C 21/00* (2006.01)
*A47C 21/02* (2006.01)

(52) U.S. Cl.
CPC ..... *A47C 21/00* (2013.01); *A47C 21/026* (2013.01)

(58) Field of Classification Search
CPC ..... A47C 21/00; A47C 21/026
USPC ..... 5/498, 659, 739, 411
See application file for complete search history.

(56) References Cited

U.S. PATENT DOCUMENTS 1,602,768 A * 10/1926 Harpold ..... A47C 21/06 5/507.1
2,154,557 A * 4/1939 Bechik ..... A47C 21/026 5/411
3,350,726 A * 11/1967 Gardner ..... A47C 21/026 5/411
4,017,919 A * 4/1977 Hemmeter ..... A47C 21/026 5/411
4,199,831 A * 4/1980 Muller ..... A47C 21/022 5/411
4,297,754 A * 11/1981 Zuniga ..... A47C 21/026 5/411
4,539,723 A * 9/1985 Hillsberry ..... A47C 27/085 24/72.5
5,218,729 A * 6/1993 Walton ..... A47C 21/022 5/504.1
5,628,080 A * 5/1997 Quintile ..... A47C 19/021 40/299.01
8,522,376 B2 * 9/2013 Rohr ..... A47C 21/026 5/411
8,918,931 B1 * 12/2014 Baker ..... A47C 21/022 5/482
9,044,365 B2 * 6/2015 Rawls-Meehan ..... A61G 7/015
9,962,006 B2 * 5/2018 Shih ..... A47C 19/021
2006/0225222 A1 * 10/2006 Vaskuthy ..... A47C 23/00 5/739
2015/0359346 A1 * 12/2015 Scarleski ..... A47C 21/00 5/658
2017/0135883 A1 * 5/2017 Franceschetti ..... A61G 7/018
2017/0208963 A1 * 7/2017 Eichelberger ..... A47C 29/003
2018/0263376 A1 * 9/2018 Scarleski ..... A47C 21/00

* cited by examiner

*Primary Examiner* — Eric J Kurilla
(74) *Attorney, Agent, or Firm* — Lewellyn Law, PLLC; Stephen Lewellyn

(57) ABSTRACT

A device for securing a mattress and foundation so that they stay in alignment during use. The device includes a pair of cups to engage a corner of a mattress lying on an underlying foundation. One cup engages the mattress and the other the foundation. A hinge region connects the two cups such that the mattress and foundation remain aligned. The device can further include fasteners to secure the cups to the mattress and foundation.

11 Claims, 8 Drawing Sheets

Section B–B

MATTRESS SECURING SYSTEM

FIELD OF THE INVENTION

This invention is in the field of mattress retainers, and in particular mattress retainers that prevent shifting of a mattress placed on a foundation or box spring.

BACKGROUND

It has become common in the bedding industry to equip beds with a combination of a mattress and underlying foundation or box spring. The mattress and box spring are normally supplied as modular components, along with other features such as a frame, headboard, and other decorative features. In most cases, the box is placed on a frame, and the mattress then placed on top of the box spring. One of the limitations of this type of arrangement lies in the fact that in the absence of any form of securement, the mattress can move relative to the box spring. This then requires frequent adjustment to re-align the mattress with the underlying box spring.

There have been several prior art solutions to this problem. For example, U.S. Pat. No. 3,350,726 (Gardner) discloses a retainer system comprising corner pieces held in place by diagonally oriented straps that maintain the mattress in position relative to the box spring or like foundation. U.S. Pat. No. 4,199,831 (Miller) discloses a similar solution to the problem. U.S. Pat. No. 8,522,376 (Rohr) discloses a mattress retainer that is permanently mounted on the underlying box spring and engages the corners of the mattress to maintain the mattress in place.

Each of these solutions have significant limitations. In some, the use of straps makes the system more complicated and more difficult to install. In others, the mounting of the corner device to the box spring requires additional tools and hardware. In addition, each of the prior art solutions compromises the ability to easily place a fitted sheet over the mattress. Thus, what is needed is a simpler, easier to install, and less obtrusive device for maintaining a mattress and box spring in alignment with each other.

SUMMARY OF THE INVENTION

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Typical bedding combinations involve placing a mattress on an underlying foundation like a box spring. The present invention comprises a device for securing a mattress and foundation combination so that do not slide relative to each other. In one aspect, the invention comprise two cups connected by a hinge. The cups are designed to engage a corner formed when a mattress is placed on a foundation.

One cup engages the corner of the mattress and the other the corners of the foundation. The hinge is flexible and permits the device to be manufactured and provided in an open, uninstalled configuration, and then by bending the device at the hinge, to bring the two cups into alignment in a flexed or installation configuration. Conveniently, the device has rounded edges so as not to cause any damage to bedding. As well, the curved shape permits easier fitting of sheets to the mattress.

The device can also include complimentary tabs and slots in the bases of the two cups so that the cups can be reversibly locked together prior to installation on a bed. Registration guides, such as ridges, may also be provided in the base so that the two cups can be easily aligned with each other. The device may also include a reversible fastener, such as a complimentary hook and loop fastener to better secure the device to either the mattress, the foundation, or both the mattress and foundation. This improves the securing function of the device and helps to better maintain the mattress in a desired position on the foundation.

In another aspect, the invention also includes a method of installation of the mattress securing device. The method involves providing a device as described herein. The device is bent at the hinge to bring the cups into oppositional alignment. If included, tabs and slots are engaged such that the device is maintained in a flexed or installation configuration. Reversible fasteners may be placed on an inner aspect of either the mattress cup or foundation cup or both. These fasteners will engage with complimentary components of the fasteners that have been positioned on the mattress, foundation or both the mattress and foundation when the device is placed at a corner of the mattress foundation combination. Preferably a device will be placed at each of the four corners formed when a mattress is placed on top of an underlying foundation, like a box spring.

There is thus provided in some embodiments, a mattress securing device for securing a mattress having a plurality of edges and mattress corners to a foundation of approximately the same outer shape and size of the mattress and having a plurality of edges and foundation corners, comprising: a mattress cupping portion having mattress base and side wall portions configured to engage a mattress corner; a foundation cupping portion having foundation base and side wall portions configured to engage a foundation corner; a hinge connecting the mattress cupping and foundation cupping portions such that the mattress cupping and foundation cupping portions can be moved between a closed position in which the adjacent surfaces of the mattress cupping and foundation cupping portions are in substantially planar alignment in proximity to each other, and an open position in which the adjacent surfaces of the mattress cupping and foundation cupping portions are spaced apart in an angular opening from the hinge open position; complimentary engagement portions on each of the mattress base and foundation base portions, which are brought into oppositional alignment and contact each other and maintain the mattress cupping and foundation cupping portions in a desired alignment when the mattress securing device is in the closed position; and at least one fastener configured to maintain the mattress securing device in position at a corner formed by a mattress and foundation at which the securing device is placed.

In some embodiments, the number of fasteners is more than one and at least one fastener is located on each of the mattress cupping portion and the foundation cupping portion. In some embodiments, the complimentary engagement portions comprise complimentary tabs and slots. In some embodiments, the device further comprises registration ridges, configured to aid in aligning the mattress cupping portion and foundation cupping portion when the device is in the flexed position. In some embodiments, the at least one fastener comprises a complimentary hook and loop combination.

There is also provided a method of securing a mattress having a plurality of edges and mattress corners to a foundation of approximately the same outer shape and size of the mattress and having a plurality of edges and foundation corners, the method comprising: providing a mattress securing device corresponding to each mattress corner each mattress securing device comprising: a mattress cupping portion having mattress base and side wall portions configured to engage a mattress corner; a foundation cupping portion having foundation base and side wall portions configured to engage a foundation corner; a hinge connecting the mattress cupping and foundation cupping portions such that the mattress cupping and foundation cupping portions can be moved between a closed position in which the adjacent surfaces of the mattress cupping and foundation cupping portions are in substantially planar alignment in proximity to each other, and an open position in which the adjacent surfaces of the mattress cupping and foundation cupping portions are spaced apart in an angular opening from the hinge open position; complimentary engagement portions on each of the mattress base and foundation base portions, which are brought into oppositional alignment and contact each other and maintain the mattress cupping and foundation cupping portions in a desired alignment when the mattress securing device is in the closed position; and at least one fastener configured to maintain the mattress securing device in position at the mattress corner at which it is placed; flexing the device at the hinge, such that the mattress base portion and foundation base portion are brought into substantial alignment with each other; securing the mattress base portion and foundation base portion using the complimentary engagement portions; placing a mattress securing device at a corner formed by a mattress situated upon an underlying foundation.

In some embodiments, the method further comprises providing at least one reversible fastener, the at least one reversible fastener configured to maintain the mattress securing device in a desired position with respect to the corner formed by a mattress situated upon an underlying foundation.

In some embodiments of the method, the at least one reversible fastener comprises a complimentary hook and loop combination, wherein the hook is affixed to one of the cupping portions of the mattress securing device, and the loop is affixed to one of the mattress and foundation such that the hook and loop are positioned to contact and engage each other when the mattress securing device is positioned at a corner formed by the mattress and foundation.

In some embodiments, the method further comprises placing a mattress securing device at one corner formed by a mattress situated upon an underlying foundation. In some embodiments, the method further comprises placing a mattress securing device at more than one corner formed by a mattress situated upon an underlying foundation. In some embodiments, the method further comprises placing a mattress securing device at each corner formed by a mattress situated upon an underlying foundation.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

FIG. 1A is a top view of the device, FIG. 1B is a cross-sectional view of the device, both views in an extended configuration prior to installation, and FIG. 1C is an alternative embodiment adapted for use with oversize bed linens.

FIG. 3A is a perspective view, FIG. 3B is a side cross-sectional view, FIG. 3C is a top view, and FIGS. 3D and 3E are perspective and top views of an alternative embodiment adapted for sue with oversized bed linens.

DETAILED DESCRIPTION OF THE INVENTION

The following discussion provides examples of embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Those of skill in the art will recognize that the described embodiment are examples of possible configurations of the invention, and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

In the present disclosure, the use of the terms "foundation" and "box spring" are used interchangeably to refer to those components of a bed system upon which a mattress is typically placed. A common type of bedding system incorporates the use of a mattress placed on top of a foundational structure such as a box spring. In most installations, the mattress is simply placed on top of the box spring. Initial alignment of the mattress on the box spring is made relatively simple by the fact that mattress and box spring sets are manufactured such that the length and width of each are essentially identical.

However, through use, over time the mattress can shift in position on the box spring such that they are no longer in alignment. The creates several problems, including the possibility that the mattress might completely slip off the box spring. Another is that when the mattress shifts, the bedding, which is frequently tucked in between the mattress and box spring can become untucked, leading to an unsightly unkempt appearance that many people find aesthetically displeasing. The present disclosure provides an improved apparatus and method for generally securing a mattress to an underlying matching box spring in such a way as to substantially prevent movement of one relative to the other when in use.

Figure 1B:
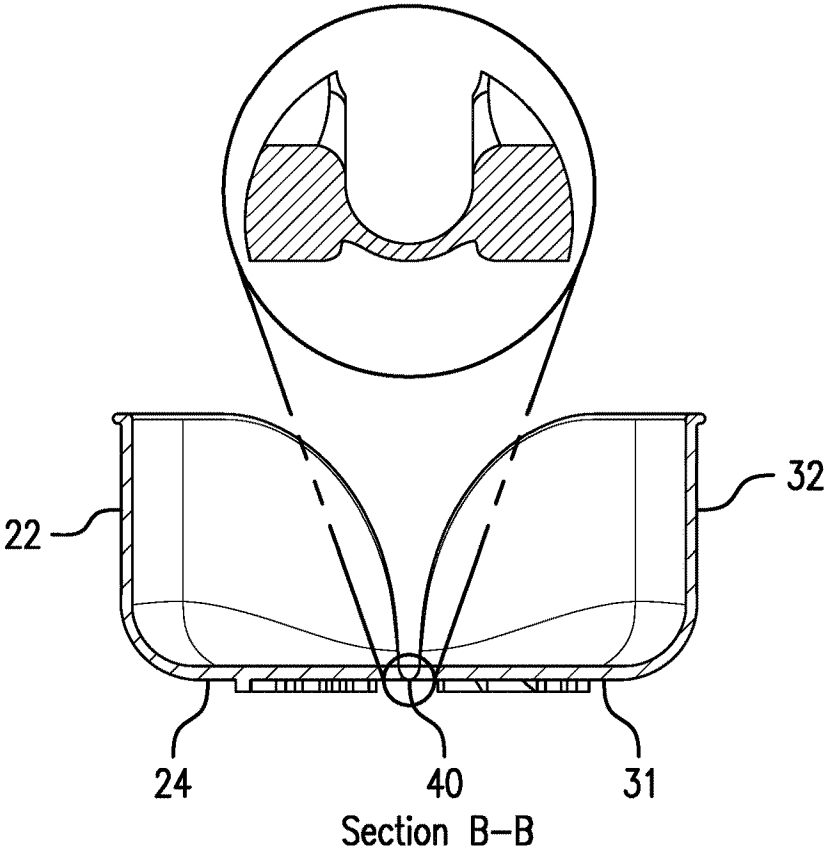
FIGS. 1A-1C provide views of an embodiment of a mattress securing device of the present disclosure, where
Figure 1A:
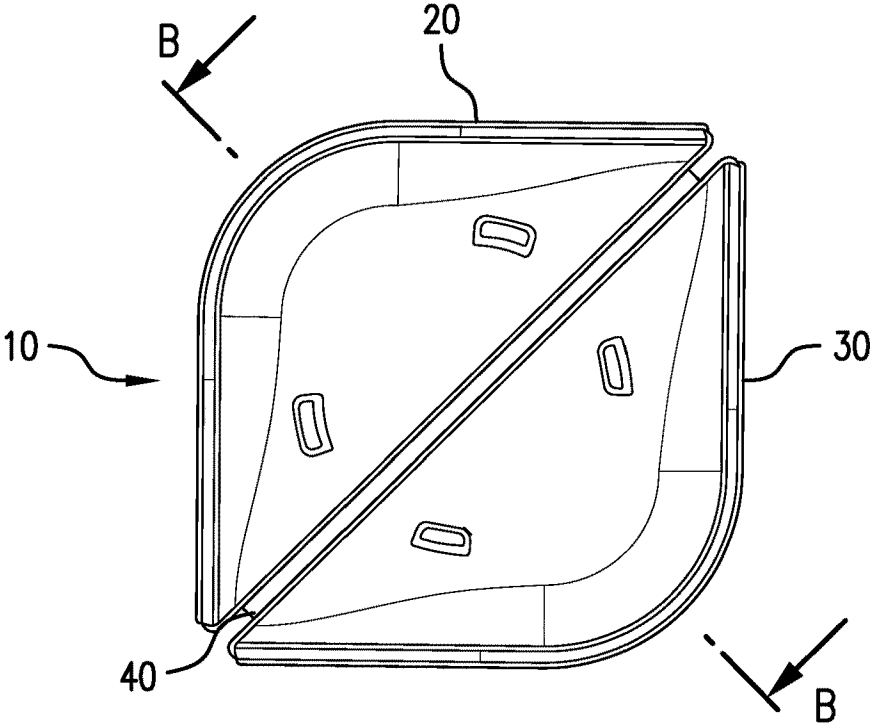
Figure 1C:
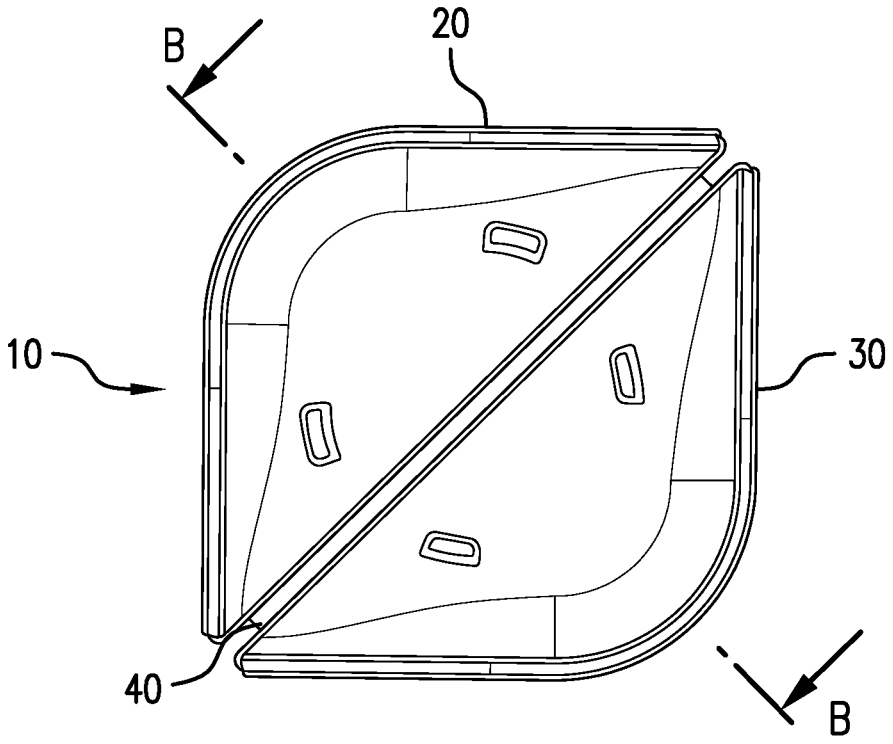

In a preferred embodiment, a mattress and foundation securement apparatus 10 comprises a mattress cupping portion 20 and a foundation cupping portion 30 connected to each other by a hinge 40. As shown in FIGS. 1A and 1B, each of the cupping portions further comprises a base portion 21, 31 and side wall portion 22, 32. The mattress base portion 21 and side wall portion 22 are designed to engage the underside and corner of the mattress, respectively. The foundation base portion 31 and side wall portion 32 are designed to engage the upper surface and corner of a box spring, respectively. In some embodiments, each cupping portion forms a roughly right-angled shape that can engage a corner of the mattress and a foundation such as a box spring. The degree to which each cupping portion extends along an edge of the mattress and foundation, or is not limiting to the scope of the invention.

Figure 2:
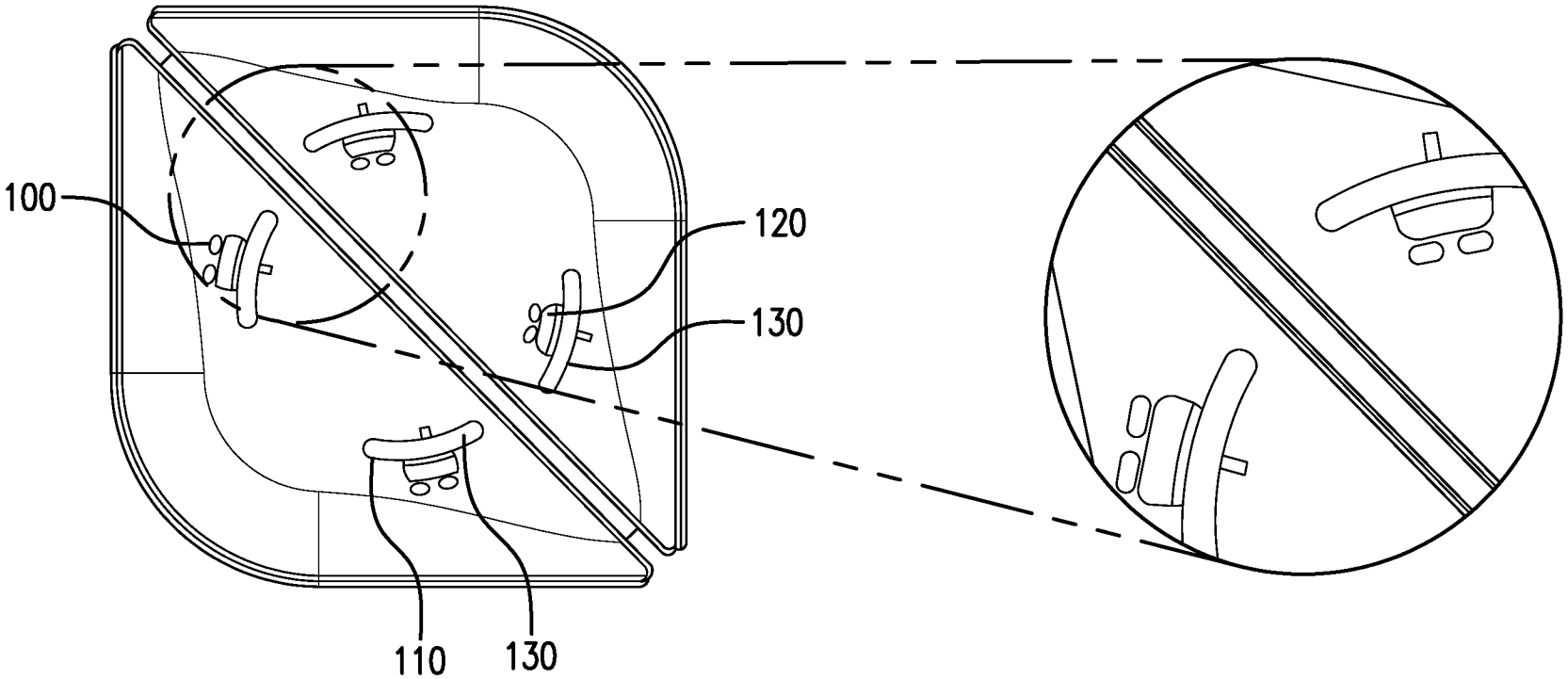
FIG. 2 is a bottom view of an embodiment of a mattress securing device of the present disclosure.
Figure 2A:
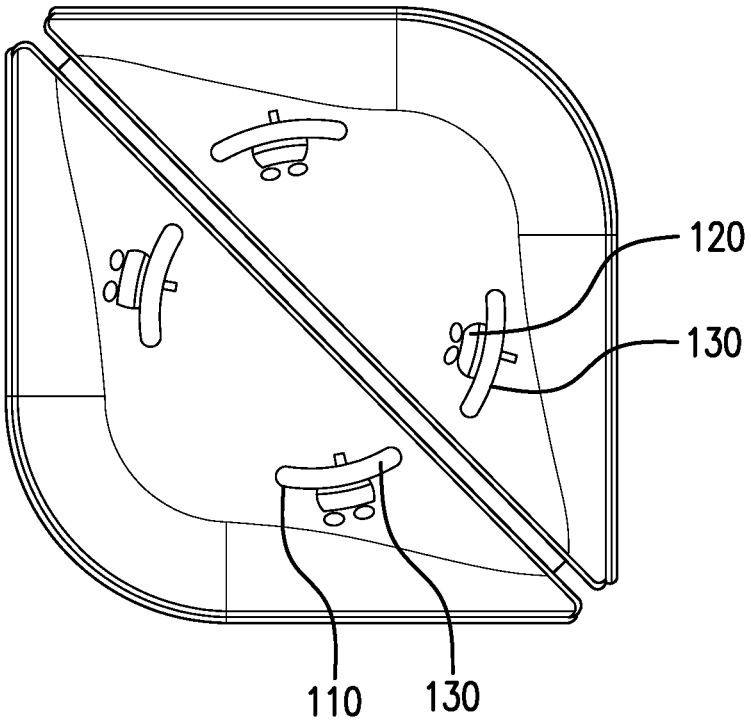
FIG. 2A is an alternative embodiment adapted for use with oversize bed linens.

Each of the mattress cupping portion 20 and foundation cupping portion 30 are connected to each other by a hinge. Prior to installation, the device will generally conform to the shape as shown in FIGS. 1A and 1B and FIG. 2, which can be thought of as an open configuration. As can also be seen in FIG. 2, each of the cupping portions also includes complimentary engagement structures such that when the device is folded at the hinge 40 prior to installing, the mattress and foundation cupping portions are reversibly engaged to each other such that a substantially fixed position between them is maintained. In some embodiments, a tab 110 is configured to engage a slot 120. Tabs 110 can be placed on the mattress portion and slots 120 on the foundation portion, and vice versa. Alternatively, each portion may have both tabs and slots corresponding to complimentary tabs and slots on the other portion. The number of tabs and slots may be varied as well. The representative drawings show 4 tabs and slots, but other numbers of tabs and slots can be used with equal effectiveness and thus are not intended to be limiting to the scope of the invention as set forth in the claims. In addition, in some embodiments, there may also be included registration ridges 130 that serve as aligning structure to more easily guide the tabs and slots into position.

Figure 3A:
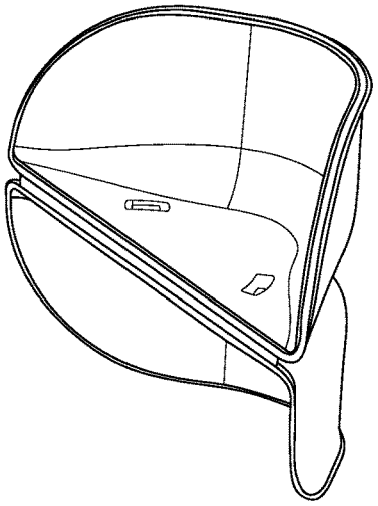
FIGS. 3A-3E are views of an embodiment of a mattress securing device of the present disclosure in the folded configuration, where
Figure 3B:
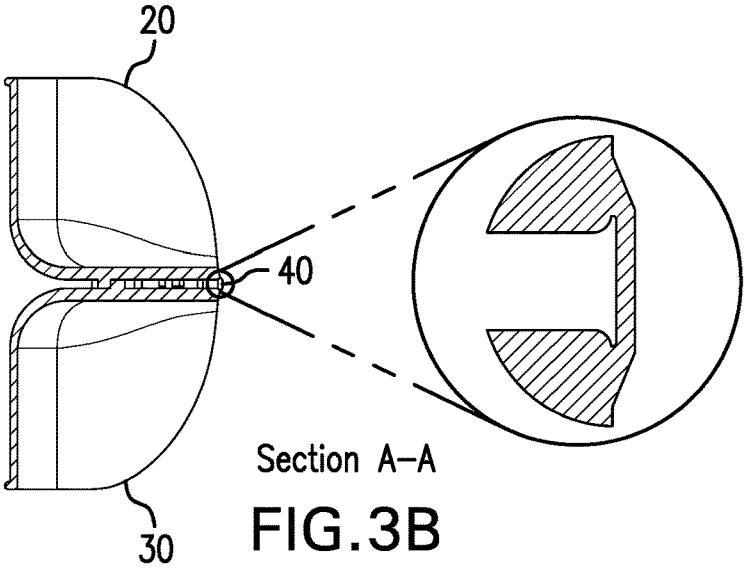
Figure 3C:
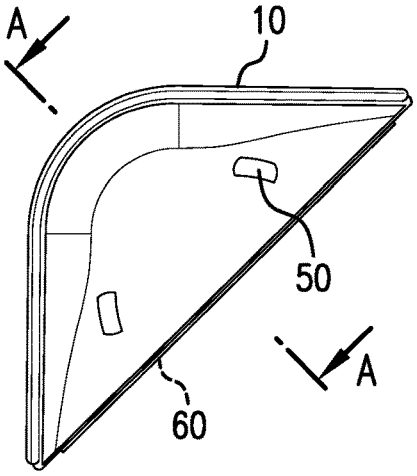
Figure 3D:
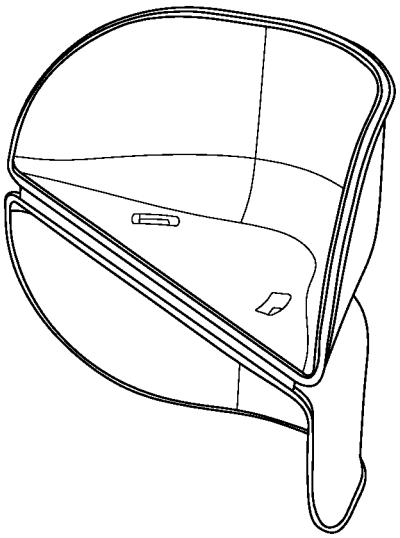
Figure 3E:
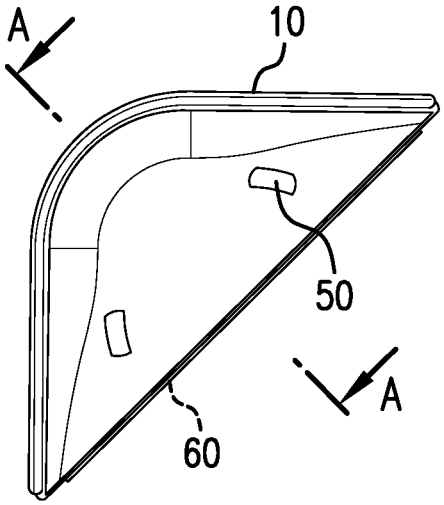

As shown in FIGS. 3A-3C, the device is configured to be bendable at the hinge 40 such that the mattress cupping and foundation cupping portions can be brought into oppositional alignment with each other. In this configuration, which can be considered as a flexed or in use configuration, each of the mattress base portion 21 and foundation base portion 31 will be a generally planar alignment, with the mattress side wall portion 22 and foundation side wall portion 32 extending outward at approximately right angles relative to the plane formed by the base portions.

Figure 4:
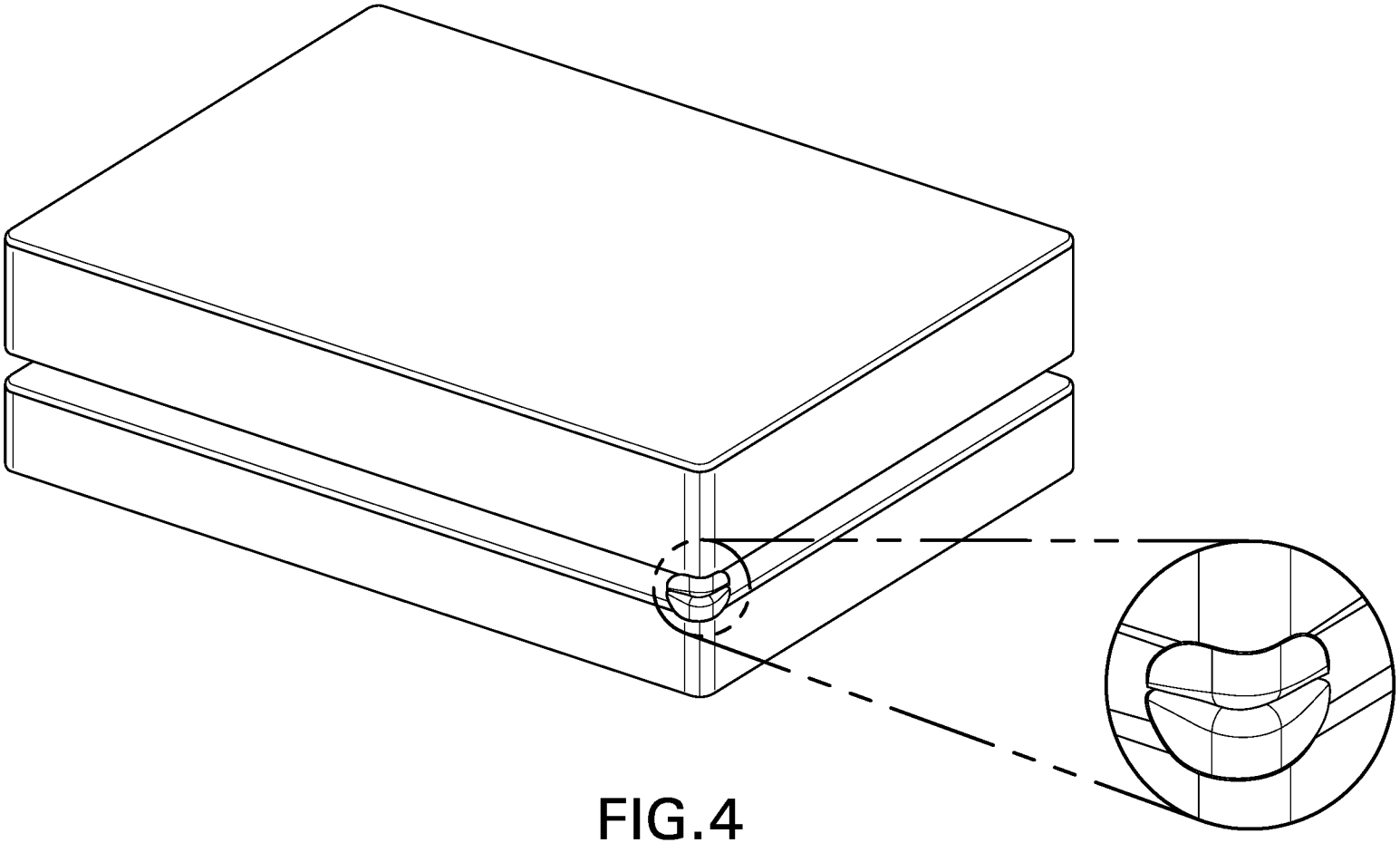
FIG. 4 is a perspective view of an embodiment of a mattress securing device of the present disclosure depicting one method of installation to maintain a mattress and underlying box spring in a secured position.
Figure 5B:
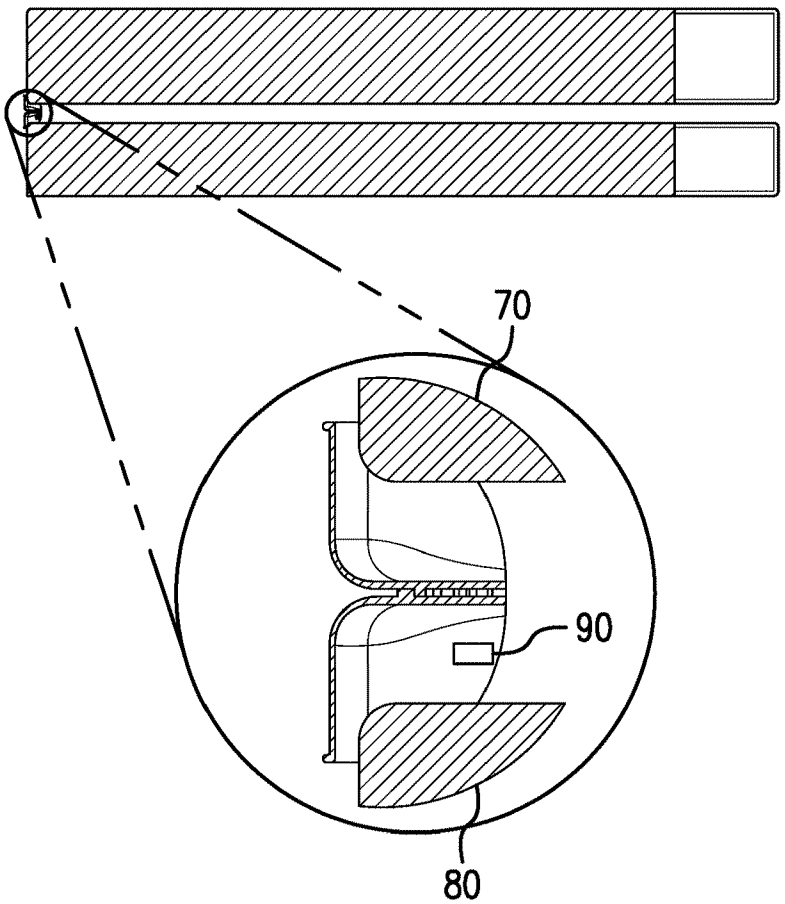
FIG. 5B is a side corss-sectional view taken along line H-H in FIG. 5C, which is a top view of the mattress of FIG. 5A.
Figure 5A:
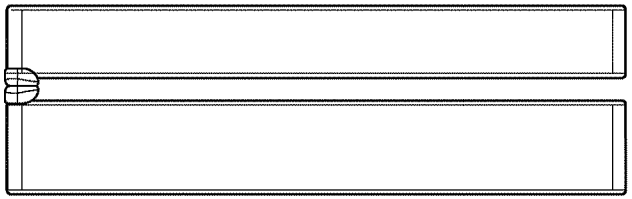
FIG. 5A is a side elevation view of an embodiment of a mattress securing device of the present disclosure in relation to a mattress and box spring to be secured.
Figure 5C:
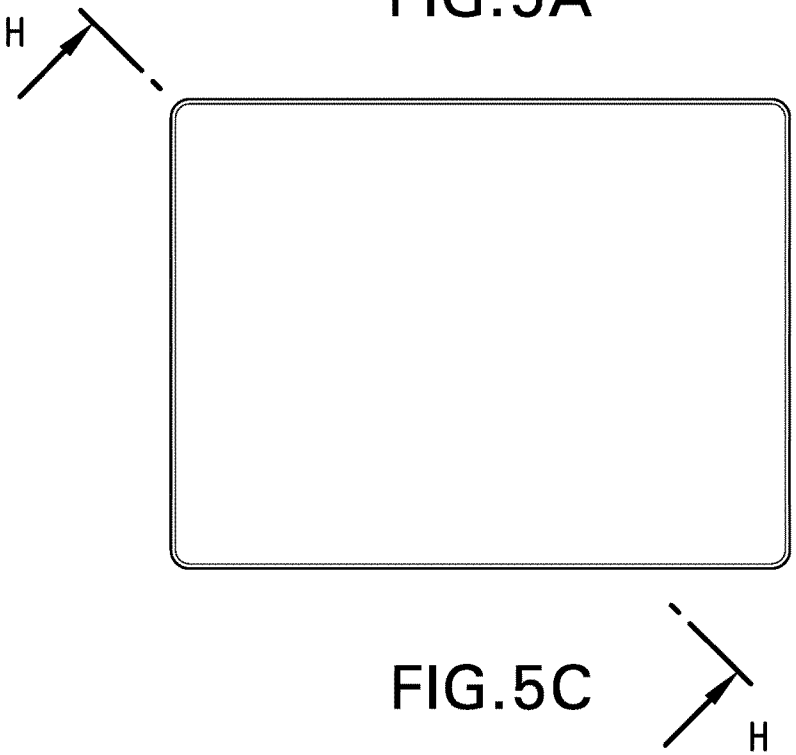

To most effectively secure a mattress and foundation combination one apparatus 10 will be placed at each of the corners formed by the mattress when placed on the foundation, as is depicted in FIGS. 4 and 5. Prior to placement, each apparatus will be flexed at the hinge so that the base portions engage each other, as shown in FIGS. 3A-3C. Conveniently, the tabs and slots are positioned so that they engage and maintain the device now in this folder structure prior to placement at a corner of the mattress foundation combination. In addition, and as shown in FIG. 5B, it will be advantageous to provide additional means with which to secure the apparatus to each of the mattress and foundation. In some embodiments, the fastener may comprise a complimentary hook and loop fastener combination. Using such fasteners, the hook portion of the fastener will be affixed to at least one of the cupping portions, and the loop portion affixed to the mattress or foundation in such a manner as the hook and loop fasteners portions contact and engage each other to maintain the mattress securing device in position, which in turn maintains the mattress in position relative to the underlying foundation.

When put in place, and as shown in FIG. 5B, it may be desirable to leave a space between the inner aspect of the cupping portions and the mattress and foundation. Conveniently this space may be desired to receive a fitted sheet commonly placed on mattresses, as well as a bed skirt, commonly placed on the top of a foundation.

The base regions are configured to be placed in planar alignment with the bottom of the mattress and top of the foundation, respectively. In all cases, a user will place a mattress securing device at each of the four corners of a mattress foundation combination and as such the mattress will never need to be lifted in order to install bedding.

In some cases it will be desirable to use the mattress securing device in conjunction with over-sized bed linens. In that case it may be advisable to provide devices with a different arrangement of tabs and slots, as depicted in FIGS. 1C, 2A, 3D and 3E. In these embodiments, more space is provided along the curved portion of the mattress securing device so that more room is available in which to fit linens.

It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A mattress securing device comprising:

a mattress cupping portion having mattress base and side wall portions configured to engage a mattress corner;

a foundation cupping portion having foundation base and side wall portions configured to engage a foundation corner;

a hinge connecting the mattress cupping and foundation cupping portions such that the mattress cupping and foundation cupping portions can be moved between a closed position in which the adjacent surfaces of the mattress cupping and foundation cupping portions are in substantially planar alignment in proximity to each other, and an open position in which the adjacent surfaces of the mattress cupping and foundation cupping portions are spaced apart in an angular opening from the hinge open position;

complimentary engagement portions on each of the mattress base and foundation base portions, which are brought into oppositional alignment and contact each other and maintain the mattress cupping and foundation cupping portions in a desired alignment when the mattress securing device is in the closed position; and at least one fastener configured to maintain the mattress securing device in position at a corner formed by a mattress corner of a mattress and a foundation corner of a foundation when the mattress securing device is placed at the corner.

2. The mattress securing device of claim 1, wherein the number of fasteners is more than one and wherein at least one fastener is located on each of the mattress cupping portion and the foundation cupping portion.

3. The mattress securing device of claim 1, wherein the complimentary engagement portions comprise complimentary tabs and slots.

4. The mattress securing device of claim 1 further comprising registration ridges, configured to aid in aligning the mattress cupping portion and foundation cupping portion when the device is in the flexed position.

5. The mattress securing device of claim 1, wherein the at least one fastener comprises a complimentary hook and loop combination.

6. A method of securing a mattress having a plurality of edges and mattress corners to a foundation of approximately the same outer shape and size of the mattress and having a plurality of edges and foundation corners, the method comprising:

providing a mattress securing device corresponding to each mattress corner each mattress securing device comprising:

a mattress cupping portion having mattress base and side wall portions configured to engage a mattress corner;

a foundation cupping portion having foundation base and side wall portions configured to engage a foundation corner;

a hinge connecting the mattress cupping and foundation cupping portions such that the mattress cupping and foundation cupping portions can be moved between a closed position in which the adjacent surfaces of the mattress cupping and foundation cupping portions are in substantially planar alignment in proximity to each other, and an open position in which the adjacent surfaces of the mattress cupping and foundation cupping portions are spaced apart in an angular opening from the hinge open position;

complimentary engagement portions on each of the mattress base and foundation base portions, which are brought into oppositional alignment and contact each other and maintain the mattress cupping and foundation cupping portions in a desired alignment when the mattress securing device is in the closed position; and at least one fastener configured to maintain the mattress securing device in position at the mattress corner at which it is placed;

flexing the device at the hinge, such that the mattress base portion and foundation base portion are brought into substantial alignment with each other;

securing the mattress base portion and foundation base portion using the complimentary engagement portions; and placing a mattress securing device at a corner formed by a mattress situated upon an underlying foundation.

7. The method of claim 6, further comprising providing at least one reversible fastener, the at least one reversible fastener configured to maintain the mattress securing device in a desired position with respect to the corner formed by a mattress situated upon an underlying foundation.

8. The method of claim 7, where the at least one reversible fastener comprises a complimentary hook and loop combination, wherein the hook is affixed to one of the cupping portions of the mattress securing device, and the loop is affixed to one of the mattress and foundation such that the hook and loop are positioned to contact and engage each other when the mattress securing device is positioned at a corner formed by the mattress and foundation.

9. The method of claim 6, comprising placing a mattress securing device at one corner formed by a mattress situated upon an underlying foundation.

10. The method of claim 6, comprising placing a mattress securing device at more than one corner formed by a mattress situated upon an underlying foundation.

11. The method of claim 6, comprising placing a mattress securing device at each corner formed by a mattress situated upon an underlying foundation.

* * * * *